US006624124B2

(12) United States Patent
Garmier

(10) Patent No.: US 6,624,124 B2
(45) **Date of Patent: *Sep. 23, 2003**

(54) BIODEGRADABLE PENETRATING LUBRICANT

(75) Inventor: William W. Garmier, Hartville, OH (US)

(73) Assignee: Renewable Lubricants, Inc., Hartville, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/036,721

(22) Filed: Nov. 7, 2001

(65) Prior Publication Data

US 2003/0040444 A1 Feb. 27, 2003

Related U.S. Application Data

(60) Provisional application No. 60/305,498, filed on Jul. 13, 2001.

(51) Int. Cl.[7] ..... C10M 141/02; C10M 105/38

(52) U.S. Cl. ..... 508/491; 167/279

(56) References Cited

U.S. PATENT DOCUMENTS

| | | | | |
|---|---|---|---|---|
| 3,917,537 | A | 11/1975 | Elsdon | |
| 4,113,633 | A | 9/1978 | Gibbons | |
| 4,248,724 | A | 2/1981 | MacIntosh | |
| 4,261,842 | A | 4/1981 | Busch et al. | |
| 4,416,788 | A | 11/1983 | Apikos | |
| 4,648,981 | A | 3/1987 | Dulin | |
| 4,885,104 | A | * 12/1989 | Sturwold | 508/433 |
| 5,380,469 | A | 1/1995 | Flider | |
| 5,399,275 | A | * 3/1995 | Lange et al. | 508/433 |
| 5,413,725 | A | 5/1995 | Lal et al. | |
| 5,580,482 | A | * 12/1996 | Chasan et al. | 508/243 |
| 5,641,734 | A | * 6/1997 | Naegely | 508/233 |
| 5,681,797 | A | 10/1997 | Lawate | |
| 5,696,066 | A | 12/1997 | Kinker et al. | |
| 5,736,493 | A | * 4/1998 | Garmier | 508/491 |
| 5,747,434 | A | 5/1998 | Lamsa et al. | |
| 5,773,391 | A | 6/1998 | Lawate et al. | |
| 5,863,872 | A | * 1/1999 | Garmier | 508/491 |
| 5,885,946 | A | 3/1999 | Lamsa | |
| 5,958,851 | A | 9/1999 | Cannon et al. | |
| 5,972,855 | A | * 10/1999 | Honary | 508/491 |
| 5,990,055 | A | * 11/1999 | Garmier | 508/491 |
| 6,018,063 | A | 1/2000 | Isbell et al. | |
| 6,028,038 | A | 2/2000 | Kusch | |
| 6,051,539 | A | 4/2000 | Kodali | |
| 6,074,993 | A | 6/2000 | Waddoups et al. | |
| 6,096,699 | A | 8/2000 | Bergemann et al. | |
| 6,121,211 | A | 9/2000 | Stachew et al. | |
| 6,159,913 | A | 12/2000 | Cannon et al. | |
| 6,191,087 | B1 | 2/2001 | Opre et al. | |
| 6,194,361 | B1 | 2/2001 | Gatlin | |
| 6,203,585 | B1 | 3/2001 | Majerczak | |
| 6,207,624 | B1 | 3/2001 | Stachew et al. | |
| 6,207,626 | B1 | 3/2001 | Cannon et al. | |

FOREIGN PATENT DOCUMENTS

| | | |
|---|---|---|
| GB | 1354749 | 5/1974 |

* cited by examiner

*Primary Examiner*—Jacqueline V. Howard
(74) *Attorney, Agent, or Firm*—Bruce McDowell; Roger D. Emerson; Daniel A. Thomson

(57) ABSTRACT

A biodegradable penetrating lubricant, comprised of:

(A) at least one triglyceride oil of the formula:

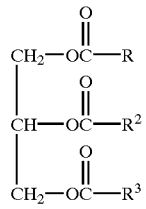

wherein $R^1$, $R^2$, and $R^3$ are aliphatic hydrocarbyl groups containing from about 7 to about 23 carbon atoms;

(B) an organic solvent selected from the group comprising:
(1) ethyl lactate,
(2) soy methyl ester,
(3) at least one mineral spirit, and
(4) combinations of 1, 2, and 3; and, (C) an antioxidant.

Optionally, the lubricant may further include an additive selected from the group comprising:

(D) an anti-wear inhibitor;

(E) a corrosion inhibitor;

(F) a pour point depressant; and, (G) a component chosen from the group comprising:
(1) a food grade tackifier;
(2) molybdenum disulfide; and
(3) a combination of 1 and 2.

50 Claims, No Drawings

BIODEGRADABLE PENETRATING LUBRICANT

This application claims the benefit of U.S. Provisional Application Ser. No. 60/305,498, filed on Jul. 13, 2001, in Express Mail Label No. EL722380724US by the same inventor, William Garmier, entitled BIODEGRADABLE PENETRATING LUBRICANT.

BACKGROUND OF THE INVENTION

1. Field of Invention

This invention pertains to the art of penetrating lubricants, and more specifically to the art of biodegradable penetrating lubricants.

2. Description of the Related Art

A demand exists for liquid compositions that have the ability to penetrate rapidly between metallic surfaces that are in close contact, such as the leaves of springs, hinges, bolts, car door locks, house locks, padlocks, pipe fittings, and the like, and to loosen the adjacent metallic surfaces that have rusted, "frozen", or otherwise become bound together. In the usual situation, a layer or film of rust between the surfaces is so tenacious that it often binds the adjacent metal surfaces so tightly that it is difficult, if not impossible, to loosen the surfaces by the use of mechanical loosening devices, such as wrenches.

A number of oil compositions are offered commercially which have been used for the purpose of lubricating such difficult to loosen surfaces, and such compositions are generally known as penetrating lubricants. These lubricants are generally characterized by having a high degree of penetration, which means that the surface tension and the viscosity of the lubricant is somewhat lower than that of an ordinary lubricant used on rotating parts.

Typically, the penetrating lubricants are comprised of petroleum-based oils. The petroleum-based oils have functioned satisfactorily, but they have several disadvantages. The petroleum based oils are only minimally biodegradable and, thus, they pose safety and contamination concerns. Further, the petroleum-based oils are non-renewable.

In contrast, vegetable oils are obtainable in large volumes from renewable resources and in general are characterized as readily biodegradable or "environmentally friendly." As a result, such oils are potentially attractive for use in a wide variety of applications, including use as a penetrating lubricant.

Use of vegetable oils as penetrating lubricants has not been thoroughly explored. Many vegetable oils do not possess the desired spectrum of characteristics relating to: pour point; oxidative stability; and compatibility with additives, among others. Vegetable oils do however possess many desirable properties for use as a penetrating lubricant. In particular, vegetable oils typically provide good lubrication, good viscosity, and high flash point. In addition, vegetable oils are generally nontoxic and readily biodegradable. For example, under standard test conditions (e.g., OCED 301D test method), a typical vegetable oil can biodegrade up to 80% into carbon dioxide and water in 28 days, as compared to 25% or less for typical petroleum-based lubricating fluids.

SUMMARY OF THE INVENTION

In accordance with the present invention, a new and improved biodegradable penetrating lubricant is provided.

It is an object of this invention to provide a biodegradable penetrating lubricant, which overcomes or otherwise mitigates the problems of the prior art in this area.

It is a further object of this invention to provide a biodegradable penetrating lubricant, which is characterized by its excellent penetrating action while still providing the necessary lubricating characteristics to achieve all the advantages required by a penetrating lubricant.

It is still further an object of this invention to provide a biodegradable penetrating lubricant, which is characterized by excellent corrosion inhibiting properties.

It is still a further object of this invention to provide a biodegradable penetrating lubricant that penetrates into close tolerant areas, then lubricates and prevents corrosion.

It is still a further object of this invention to provide a biodegradable penetrating lubricant that protects deep into the core of a cable or chain link, and is excellent as a light air tool lubricant, and preservative for oil parts.

It is still a further object of this invention to provide a biodegradable penetrating lubricant that has exceptional benefits over petroleum oils in the aforementioned applications because there is a direct loss of the lubricant into the water, soil or work environment.

Still other benefits and advantages of the invention will become apparent to those skilled in the art to which it pertains upon a reading and understanding of the following detailed specification.

To accomplish these objectives, the present invention provides for a biodegradable penetrating lubricant comprised of:

(A) at least one triglyceride oil of the formula:

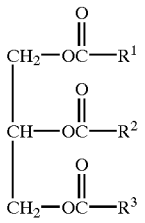

wherein $R^1$, $R^2$ and $R^3$ are aliphatic hydrocarbyl groups containing from about 7 to about 23 carbon atoms;

(B) an organic solvent selected from the group comprising:

(1) ethyl lactate, (2) soy methyl ester, (2) at least one mineral spirit, and (3) combinations of 1, 2, and 3; and, (C) an antioxidant Optionally, the lubricant may further include an additive selected from the group comprising:

(D) an antiwear inhibitor;

(E) a corrosion inhibitor;

(F) a pour point depressant;

(G) food grade tackifier; and, (H) molybdenum disulfide (A) The Triglyceride Oil In practicing this invention, the base oil is a synthetic triglyceride or a natural oil of the formula

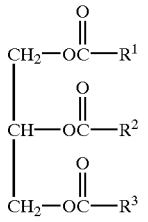

wherein $R^1$, $R^2$, and $R^3$ are aliphatic hydrocarbyl groups that contain from about 7 to about 23 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups: alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups: groups containing non-hydrocarbon substituents which, in the context of this invention, do not alter the predominantly hydrocarbon character of the group. Those skilled in the art will be aware of suitable substituents. Examples are hydroxy, carbalkoxy, (especially lower carbalkoxy) and alkoxy (especially lower alkoxy), the term, "lower" denoting groups containing not more than 7 carbon atoms.

(3) Hetero groups: groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen, and sulfur.

The triglyceride oils suitable for use in this invention are vegetable oils and modified vegetable oils. The vegetable oil triglycerides are naturally occurring oils. By "naturally occurring" it is meant that the seeds from which the oils are obtained have not been subjected to any genetic altering. Further, by "naturally occurring" it is meant that the oils obtained are not subjected to hydrogenation or any chemical treatment that alters the di- and tri-unsaturation character. The naturally occurring vegetable oils having utility in this invention comprise at least one of soybean oil, rapeseed oil, sunflower oil, coconut oil, lesquerella oil, canola oil, peanut oil, corn oil, cottonseed oil, palm oil, safflower oil, meadowfoam oil, or castor oil.

The triglyceride oils may also be modified vegetable oils. Triglyceride oils are modified either chemically or genetically. Hydrogenation of naturally occurring triglycerides is the primary means of chemical modification. Naturally occurring triglyceride oils have varying fatty acid profiles. The fatty acid profile for naturally occurring sunflower oil is

| | |
|---|---|
| palmitic acid | 70 percent |
| stearic acid | 4.5 percent |
| oleic acid | 18.7 percent |
| linoleic acid | 67.5 percent |
| linolenic acid | 0.8 percent |
| other acids | 1.5 percent |

By chemically modifying sunflower oil by hydrogenation, it is meant that hydrogen is permitted to react with the unsaturated fatty acid profile present, such as oleic acid, linoleic acid, and linolenic acid. The object is not to remove all the unsaturation. Further, the object is not to hydrogenate such that the oleic acid profile is reduced to a stearic acid profile. The object of chemical modification via hydrogenation is to engage the linoleic acid profile and reduce or convert a substantial portion of it to an oleic acid profile. The linoleic acid profile of naturally occurring sunflower oil is 67.5 percent. It is a goal of chemical modification to hydrogenate such that the linoleic acid is reduced to about 25 percent. That means that the oleic acid profile is increased from 18.7 percent to about 61 percent (18.7 percent original oleic acid profile +42.5 percent generated oleic acid from linoleic acid).

Hydrogenation is the reaction of a vegetable oil with hydrogen gas in the presence of a catalyst. The most commonly used catalyst is a nickel catalyst. This treatment results in the addition of hydrogen to the oil, thus reducing the linoleic acid profile and linolenic acid profile. Only the unsaturated fatty acid profiles participate in the hydrogenation reaction. During hydrogenation, other reactions also occur, such as shifting of the double bonds to a new position and also twisting from the cis form to the higher melting trans form.

Table I shows the oleic acid (18:1), linoleic acid (18:2), and linolenic acid (18:3) profiles of selected naturally occurring vegetable oils. It is possible to chemically modify, via hydrogenation, a substantial portion of the linoleic acid profile of the triglyceride to increase the oleic acid profile to above 60 percent.

TABLE I

| Oil | 18:1 | 18:2 | 18:3 |
|---|---|---|---|
| Corn oil | 25.4 | 59.6 | 1.2 |
| Cottonseed oil | 18.6 | 54.4 | 0.7 |
| Peanut oil | 46.7 | 32.0 | — |
| Safflower oil | 12.0 | 77.7 | 0.4 |
| Soybean oil | 23.2 | 53.7 | 7.6 |
| Sunflower oil | 18.7 | 67.5 | 0.8 |

Genetic modification occurs in the seed stock. The harvested crop then contains a triglyceride oil that when extracted has a much higher oleic acid profile and a much lower linoleic acid profile. Referring to Table I above, a naturally occurring sunflower oil has an oleic acid profile of 18.7 percent. A genetically modified sunflower oil has an oleic acid profile of 81.3 percent and linoleic acid profile of 9.0 percent. One can also genetically modify the various vegetable oils from Table I to obtain an oleic acid profile of above 90 percent. The chemically modified vegetable oils comprise at least one of a chemically modified corn oil, chemically modified cottonseed oil, chemically modified peanut oil, chemically modified palm oil, chemically modified castor oil, chemically modified canola oil, chemically modified rapeseed oil, chemically modified safflower oil, chemically modified soybean oil, and chemically modified sunflower oil.

In a preferred embodiment, the aliphatic hydrocarbyl groups of $R^1$, $R^2$ and $R^3$ are such that the triglyceride has a monounsaturated character of at least 60 percent, preferably at least 70 percent, and most preferably at least 80 percent. Triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$, and $R^3$ groups are heptadecenyl groups and the $R^1COO^-$, $R^2COO^-$, and $R^3COO^-$ to the 1,2,3-propanetriyl group $CH_2CHCH_2$ are the residue of an oleic acid molecule. U.S. Pat. No. 4,627,192 and U.S. Pat. No. 4,743,402 are herein incorporated by reference for their disclosure of the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic acid, the monounsaturated content is 70%. The preferred triglyceride oils are high oleic acid, that is, genetically modified vegetable oils (at least 60 percent) triglyceride oils. Typical high oleic vegetable oils employed within the instant invention are high oleic safflower oil, high oleic canola oil, high oleic peanut oil, high oleic corn oil, high oleic rapeseed oil, high oleic sunflower oil, high oleic cottonseed, high oleic lesquerella oil, high oleic palm oil, high oleic castor oil, high oleic meadowfoam oil, and high oleic soybean oil. Canola oil is a variety of rapeseed oil containing less than 1 percent erucic acid. A preferred high oleic vegetable oil is high oleic sunflower oil obtained from Helianthus sp. This product is available from AC Humko, Cordova, Tenn., 38018 as TriSun™ high oleic sunflower oil. TriSun 80 is a high oleic triglyceride wherein the acid moieties comprise 80 percent oleic acid. Another preferred high oleic vegetable oil is high oleic canola oil obtained from *Brassica campestris* or *Brassica napus*, also available from AC Humko as RS high oleic oil. RS80 oil signifies a canola oil wherein the acid moieties comprise 80 percent oleic acid.

It is further to be noted that genetically modified vegetable oils have high oleic acid contents at the expense of the di-and tri-unsaturated acids. A normal sunflower oil has from 20–40 percent oleic acid moieties and from 50–70 percent linoleic acid moieties. This gives a 90 percent content of mono- and di-unsaturated acid moieties (20+70) or (40+50). Genetically modifying vegetable oils generate a low di- or tri-unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

Preferably, the triglyceride oil is about 20 to about 90 weight percent of the lubricant, more preferably about 40 to about 70 weight percent, and most preferably about 50 to about 60 weight percent.

(B) The Organic Solvent

In penetrating lubricants, a balance must be reached between the penetrating function and the lubricating function. In the present invention, the triglyceride oil provides the lubricating function, while the organic solvent provides the penetrating function. Preferably, three organic solvents, namely, ethyl lactate, soy methyl ester, and food grade mineral spirits are utilized in this invention.

Ethyl lactate is the ester of natural lactic acid (a natural organic acid) produced by fermentation of corn-derived feedstock. Ethyl lactate has great penetration characteristics. It is also 100% biodegradable, breaking down into carbon dioxide and water, non-toxic, and renewable.

Mineral spirits also have great penetration characteristics. As such, any mineral spirit may be utilized in the present invention. Preferably, however, the mineral spirit is a food grade mineral spirit, such as those approved by the FDA and the USDA, and most preferably, the mineral spirit PD 23, which is manufactured by Witco, is preferred because it is not classified as a volatile organic compound by the California Air Resources Board and, thus, it is considered an environmentally friendly solvent.

The soy methyl ester can be included in the lubricant composition. Soy methyl ester is a solvent obtained from the esterfication of soy bean oil. The soy methyl ester increases the penetrating function of the lubricant by decreasing the volatility and the surface tension, thereby enabling the lubricant to penetrate between adjacent metal surfaces and free the rusted parts.

Since the soy methyl ester is a soy bean product it has many desirable properties, in addition to its great penetrating characteristics. For example, it is non-toxic, 100% biodegradable, and renewable.

Preferably, the soy methyl ester is about 5 to about 55 weight percent of the lubricant, and more preferably about 10 to about 20 weight percent.

The organic solvent is preferably about 10 to about 65 weight percent of the lubricant, more preferably about 15 to about 40 weight percent, and most preferably about 20 to about 30 weight percent.

(C) The Antioxidant

To improve the oxidative stability of the lubricant, an antioxidant may be included in the lubricant composition. Antioxidants are available off the shelf from a variety of vendors and manufacturers. Any antioxidant may be utilized in the present invention. However, metal free antioxidants are preferred because they enhance the biodegradability of the lubricant. A preferred antioxidant is phenyl alpha napthylamine (PANA).

The antioxidant is typically about 0.1 to 4 weight percent of the lubricant composition. If PANA is used as the antioxidant, then the antioxidant is preferably about 0.1 to about 2 weight percent of the lubricant.

(D) The Anti-Wear Inhibitor

To prevent wear on the metal surface, the present invention utilizes an anti-wear inhibitor. Anti-wear inhibitors are available off the shelf from a variety of vendors and manufacturers. Any anti-wear inhibitor may be utilized in the present invention. However, metal free anti-wear inhibitors are preferred, and phosphorous and sulfur containing metal free anti-wear inhibitors are most preferred.

Preferably, food grade anti-wear inhibitor are utilized in the present invention because they comply with FDA regulations, thereby, making the lubricant more environmentally friendly. One food grade anti-wear inhibitor is phosphorous amine salt of the formula:

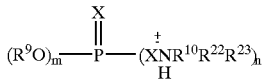

wherein $R^9$ and $R^{10}$ are independently aliphatic groups containing from about up to about 24 carbon atoms, $R^{22}$ and $R^{23}$ are independently hydrogen or aliphatic groups containing from about 1 up to about 18 aliphatic carbon atoms, the sum of m and n is 3 and X is oxygen or sulfur. In a preferred embodiment, $R^9$ contains from about 8 up to 18 carbon atoms, $R^{10}$ is

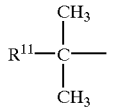

wherein $R^{11}$ is an aliphatic group containing from about 6 up to about 12 carbon atoms, $R^{22}$ and $R^{23}$ are hydrogen, m is 2, n is 1, and X is oxygen. An example of one such phosphorous amine salt is Irgalube® 349, which is commercially available from Ciba-Geigy.

Another food grade anti-wear inhibitor is phosphorous compound of the formula:

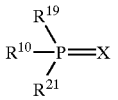

wherein $R^{19}$, $R^{20}$, and $R^{21}$ are independently hydrogen, an aliphatic or alkoxy group containing from 1 up to about 12 carbon atoms, or an aryl or aryloxy group wherein the aryl group is phenyl or naphthyl and the aryloxy group is phenoxy or naphthoxy and X is oxygen or sulfur. An example of one such phosphorus compound is triphenyl phosphothionate (TPPT), which is commercially available from Ciba-Geigy under the trade name Irgalube® TPPT.

The anti-wear inhibitor is typically about 0.1 to 4 weight percent of the lubricant composition.

(E) The Corrosion Inhibitor

To prevent corrosion of the metal surfaces, the present invention utilizes a corrosion inhibitor. Corrosion inhibitors are available off the shelf from a variety of vendors and manufacturers. Any corrosion inhibitor may be utilized in the present invention, but metal free corrosion inhibitors are preferred.

The corrosion inhibitor is typically about 0.01 to 4 weight percent of the lubricant composition.

The corrosion inhibitor is preferably comprised of a corrosion additive and a metal deactivator. Preferably, the additive and the metal deactivator are food grade and comply with FDA regulations, thereby, making the lubricant more environmentally friendly. One additive is the N-acyl derivative of sarcosine, which has the formula:

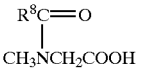

wherein $R^8$ is an aliphatic group containing from 1 up to about 24 carbon atoms. Preferably $R^8$ contains from 6 to 24 carbon atoms and most preferably from 12 to 18 carbon atoms. An example of an additive of N-acyl derivative of sarcosine is N-methyl-N-(1-oxo-9-octadecenyl) glycine wherein $R^8$ is a heptadecenyl group. This derivative is available from Ciba-Geigy under the trade name Sarkosyl® O.

Another additive is imidazoline of the formula:

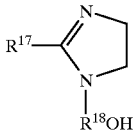

wherein $R^{17}$ is an aliphatic group containing from 1 up to about 24 carbon atoms and $R^{18}$ is an alkylene group containing from 1 up to about 24 carbon atoms. Preferably $R^{17}$ is an alkenyl group containing from 12 to 18 carbon atoms. Preferably $R^{18}$ contains from 1 to 4 carbon atoms and most preferably $R^{18}$ is an ethylene group. An example of one such imadazoline has the formula:

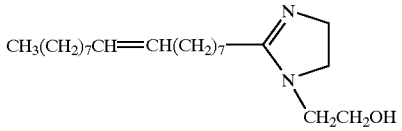

and is commercially available from Ciba-Geigy under the trade name Amine O.

Typically, the corrosion additive is about 0.01 to 4 weight percent of the lubricant composition. If the additive is the N-acyl derivative of sarcosine, then it is preferably about 0.1 to about 1 weight percent of the lubricant composition. If the additive is imidazoline, then it is preferably about 0.05 to about 2 weight percent of the lubricant composition. The lubricant can include more than one corrosion additive. For example, the lubricant can include both the N-acyl derivative of sarcosine and imidazoline.

One metal deactivator is triazole or substituted triazole. For example, toly-triazole or tolu-triazole may be utilized in the present invention. However, a preferred triazole, is tolu-triazole sold commercially by Ciba-Geigy under the trade name Irgamet 39, which is a food grade triazole and, thus, environmentally friendly.

Typically, the metal deactivator is about 0.05 to 0.3 weight percent of the lubricant composition. If the metal activator is Irgamet 39, then it is preferably about 0.05 to about 0.2 weight percent of the lubricant composition.

Although, the anti-wear inhibitor and the corrosion inhibitor have been described separately, they can be included in a single chemical additive. For example, both the anti-wear inhibitor and the corrosion inhibitor are included in the non-food grade additive Lubrizol® 5186B, which is available form Lubrizol Corporation. Preferably, Lubrizol® 5186B is about 0.5 to 2 weight percent of the lubricant composition and, most preferably, about 1.25 weight percent of the lubricant.

(F) The Pour Point Depressant

There is a natural stiffening at low temperatures of vegetable oils, especially vegetable oils with a high monounsaturation content. This is analogous to the stiffening of honey or molasses at a reduced temperature. To maintain the "pour" or "flow" of a vegetable oil at reduced temperatures, it becomes necessary to add a pour point depressant.

Pour point depressants are available off the shelf from a variety of vendors and manufactures. Any pour point depressant may be utilized in the present invention. Preferably, however, the pour point depressant is an alkylated polystyrene or a polyalkyl methacrylate.

Two different reaction routes are envisioned in preparing the alkylated polystyrenes. The first route involves reacting either an alkyl chloride or an alkene with styrene to form an alkylated styrene. The alkylated styrene is then polymerized to form an alkylated polystyrene. In the second route styrene is polymerized to form polystyrene and propylene or butylenes or mixtures thereof are polymerized to form polypropylene, polybutylenes or mixtures of polypropylenes and polybutylenes, also known as polyalkylenes. The polystyrene is then alkylated with the polyalkylenes to form the alkylated polystyrenes.

A preferred pour point depressant in the class of alkylated polystyrene is Keil-Flo™ 150, available from Ferro Corporation—Petroleum Additives, 3000 Sheffield Avenue, Hammond, Ind. 46327.

The polyalkyl methacrylates suitable for use in the present invention are prepared by the polymerization of $C_1$–$C_{30}$ methacrylates. Preparation of these polymers may further include the use of acrylic monomers having nitrogen-containing functional groups, hydroxy groups and/or alkoxy groups which provide additional properties to the polyalkyl methacrylates such as improved dispersancy. The polyalkyl methacrylates preferably have a number average molecular weight of from 10,000 to 250,000 and preferably 20,000 to 200,000. The polyalkyl methacrylates may be prepared by conventional methods of free-radical or anionic polymerization. A preferred pour point depressant in the class of polyalkyl methacrylates is EF 171 available from RohMax, USA, Delran, N.J. 08075.

The pour point depressant is typically about 0.2 to 4 weight percent of the lubricant composition.

(G) Food Grade Tackifier

The addition of a food grade tackifier provides adhesiveness to the performance of the bio-penetrating lubricant. Some applications and environmental conditions may require an additional tacky surface film that protects equipment from corrosion. The tackifier also holds the lubricant to the surface of the moving parts and improves anti-wear. In this embodiment, the tackifier is 1 to 2 weight percent of the lubricant. However, the tackifier can be from about 0.5 to about 5 weight percent. An example of a food grade tackifier that can be used in this invention is Functional V-584 Natural Rubber Tackifier for Fatty-Oil Based Lubricants/Food Grade, which is available from Functional Products, Inc., Macedonia, Ohio.

(H) Molybdenum Disulfide

The bio-penetrating lubricant with molybdenum disulfide is formulated to penetrate into close tolerant areas, then lubricate, and prevent corrosion. It protects deep into the core of a cable or chain link. The addition of molybdenum disulfide adds exceptional anti-wear/extreme pressure performance that is more resistant to dust and dirt than the bio-penetrating lubricant with the tackifier. In this embodiment, the molybdenum disulfide is 1.0 weight percent of the lubricant, but can be about 0.5 to about 5 weight percent of the lubricant.

In another embodiment of this invention, the bio-penetrating lubricant may contain both the tackifier and the molybdenum disulfide. This embodiment has performance advantages in applications such as high speed roller chains, cables, and moving parts. The lubricant in this embodiment penetrates rapidly and adheres to the application, forming a lubricant film that cannot be wiped away by extreme pressures and high speeds. The lubricant protects metal surfaces from rust and corrosion that are exposed to environmental conditions.

Preferably, all of the chemicals, except for the anti-wear inhibitor, are food grade to enhance the biodegradability of the penetrating lubricant. However, any grade of chemicals chosen within sound judgment may be utilized by the present invention.

EXAMPLE

A biodegradable penetrating lubricant was prepared by mixing the following components in the amounts indicated:

TABLE II

| Component | Weight Percent |
|---|---|
| Triglyceride oil (holly canola) | 56.4 |
| PD 23 | 25.0 |
| Lubrizol ® 5186B | 1.0 |
| Antioxidant (PANA) | 0.6 |
| Soy methyl ester | 15.0 |
| Pour Point Depressant (polyalkyl methacrylate) | 2.0 |

The lubricant was tested by subjecting it to a thread creep test. A rusted ⅜-inch bolt was placed on its head in a beaker filled with approximately ¼ inch of the lubricant. The lubricant vertically walked about 2 inches of the thread in 2 hours, thereby, demonstrating exceptional penetrating characteristics.

The lubricant was also found to have the following physical properties:

TABLE III

| | | |
|---|---|---|
| Specific Gravity @ 60° F. | ASTM D-287 | 0.88 |
| Viscosity @ 40° C., cSt | ASTM D-445 | 14.4 |
| Flash Point, PMCC | ASTM D-93 | 295° F. (146° C.) |
| Pour Point (Rotational) | ASTM D5985 | −30° C. |
| Freeze Point | ASTM D5985 | −31° C. |
| Rust Prevention | ASTM D 665 | |
| Distilled Water | | Pass-Clean |
| Synthetic Sea Water | | Pass-Clean |
| Copper Corrosion Strip 3 hr @ 100° C. | ASTM D 130 | 1A |
| 4-Ball Wear, 1 h, 167° F., 1200 RPM, 40 kg | ASTM D 4172 | 0.40 |

The invention has been described with reference to several embodiments. Obviously, modifications and alterations will occur to others upon a reading and understanding of this specification. It is intended to include all such modifications and alternations in so far as they come within the scope of the appended claims or the equivalence thereof.

What is claimed is:

1. A composition, comprising:

at least one triglyceride oil of the formula

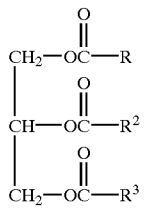

wherein $R^1$, $R^2$, and $R^3$ are aliphatic hydrocarbyl groups containing from about 7 to about 23 carbon atoms;

(B) an organic solvent selected from the group comprising:

(1) ethyl lactate, (2) soy methyl ester, (3) at least one mineral spirit, and (4) combinations of 1, 2, and 3; and, (C) an antioxidant.

2. The composition of claim 1 wherein, the triglyceride oil (A) is a naturally occurring vegetable oil.

3. The composition of claim 1 wherein, the triglyceride oil (A) is a modified vegetable oil.

4. The composition of claim 2 wherein, the naturally occurring vegetable oil is at least one of the group comprising: of soybean oil, rapeseed oil, sunflower oil, coconut oil, lesquerella oil, canola oil, peanut oil, corn oil, cottonseed oil, palm oil, safflower oil, meadowfoam oil, and castor oil.

5. The composition of claim 3 wherein, the modified vegetable oil is chosen from the group comprising: chemically modified vegetable oil, and genetically modified vegetable oil.

6. The composition of claim 5 wherein, $R^1$, $R^2$, and $R^3$ have at least a 60 percent monounsaturation content derived from an oleic acid residue.

7. The composition of claim 1 wherein, the triglycerirde oil (A) is about 20 to 90 weight percent based upon the weight of the composition.

8. The composition of claim 1 wherein, the triglycerirde oil (A) is about 40 to about 70 weight percent based upon the weight of the composition.

9. The composition of claim 1 wherein, the triglycerirde oil (A) is about 50 to about 60 weight percent based upon the weight of the composition.

10. The composition of claim 1 wherein, the antioxidant (C) is about 0.1 to about 4 weight percent based upon the weight of the composition.

11. The composition of claim 1 wherein, the antioxidant (C) is about 0.1 to about 2 weight percent based upon the weight of the composition.

12. The composition of claim 1 wherein, the anti-oxidant (C) is a metal free, antioxidant.

13. The composition of claim 12 wherein, the anti-oxidant (C) is phenyl alpha napthylamine.

14. The composition of claim 1 wherein, the organic solvent (B) is about 10 to about 65 weight percent based upon the weight of the composition.

15. The composition of claim 1 wherein, the organic solvent (B) is about 15 to about 40 weight percent based upon the weight of the composition.

16. The composition of claim 1 wherein, the organic solvent (B) is about 20 to about 30 weight percent based upon the weight of the composition.

17. The composition of claim 1 wherein, the organic solvent (B) is a food grade, organic solvent.

18. The composition of claim 1 further comprising an anti-wear inhibitor (D).

19. The composition of claim 18 wherein, the anti-wear inhibitor (D) is about 0.1 to about 4 weight percent based upon the weight of the composition.

20. The composition of claim 19 wherein, the anti-wear inhibitor (D) is a metal free, food grade, inhibitor.

21. The composition of claim 20 wherein, the anti-wear inhibitor (D) includes sulfur.

22. The composition of claim 20 wherein, the anti-wear inhibitor (D) includes phosphorous.

23. The composition of claim 1 further comprising, a corrosion inhibitor (E).

24. The composition of claim 23 wherein, the corrosion inhibitor (E) is about 0.01 to about 4 weight percent based upon the weight of the composition.

25. The composition of claim 23 wherein, the corrosion inhibitor (E) is a metal free, food grade, inhibitor.

26. The composition of claim 25 wherein, the corrosion inhibitor (E) includes at least one triazole.

27. The composition of claim 25 wherein, the corrosion inhibitor (E) includes at least one substituted triazole.

28. The composition of claim 1 further comprising, a pour point depressant (F).

29. The composition of claim 28 wherein, the pour point depressant (F) is about 0.2 to about 4 weight percent based upon the weight of the composition.

30. The composition of claim 28 wherein, the pour point depressant (F) is selected from the group comprising alkylated polystyrene and polyalkyl methacrylate.

31. The composition of claim 1 wherein, the soy methyl ester (G) is about 5 to about 55 weight percent based upon the weight of the composition.

32. The composition of claim 31 wherein, the soy methyl ester (G) is about 10 to about 20 weight percent based upon the weight of the composition.

33. The composition of claim 1 further comprising a food grade tackifier.

34. The composition of claim 33 wherein, the tackifier is about 0.5 to about 5 weight percent based upon the weight of the composition.

35. The composition of claim 1 further comprising molybdenum disulfide.

36. The composition of claim 35 wherein, the molybdenum disulfide is about 0.5 to about 5 weight percent based upon the weight of the composition.

37. The composition of claim 35 further comprising a food grade tackifier.

38. A biopenetrating lubricant, comprising:

(A) at least one triglyceride oil of the formula

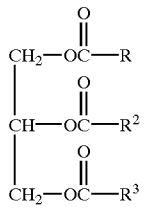

wherein $R^1$, $R^2$, and $R^3$ are aliphatic hydrocarbyl groups containing from about 7 to about 23 carbon atoms;

(B) an organic solvent selected from the group comprising:

(1) ethyl lactate, (2) soy methyl ester, (3) at least one mineral spirit, and (4) combinations of 1, 2, and 3; and, (C) an anti-oxidant; and, at least one additive selected from the group comprising an anti-wear inhibitor (D), a corrosion inhibitor (E), and pour point depressant (F).

39. The biopenetrating lubricant of claim 38 wherein, the triglycerirde oil (A) is about 20 to about 90 weight percent based upon the weight of the biopenetrating lubricant.

40. The biopenetrating lubricant of claim 38 wherein, the antioxidant (C) is about 0.1 to about 4 weight percent based upon the weight of the biopenetrating lubricant.

41. The biopenetrating lubricant claim 40 wherein, the antioxidant (C) is a metal free, antioxidant.

42. The biopenetrating lubricant of claim 38 wherein, the organic solvent (B) is about 10 to about 65 weight percent based upon the weight of the biopenetrating lubricant.

43. The biopenetrating lubricant of claim 38 wherein, the organic solvent (B) is a food grade, organic solvent.

44. The biopenetrating lubricant of claim 38 wherein, the antiwear inhibitor (D) is about 0.1 to about 4 weight percent based upon the weight of the biopenetrating lubricant.

45. The biopenetrating lubricant of claim 38 wherein, the antiwear inhibitor (D) is a metal free, food grade, inhibitor.

46. The biopenetrating lubricant of claim 38, wherein the corrosion inhibitor (E) is about 0.01 to about 4 weight percent based upon the weight of the biopenetrating lubricant.

47. The biopenetrating lubricant of claim 38 wherein, the corrosion inhibitor (E) is a metal free, food grade, inhibitor.

48. The biopenetrating lubricant of claim 38 wherein, the pour point depressant (F) is about 0.2 to about 4 weight percent based upon the weight of the biopenetrating lubricant.

49. The biopenetrating lubricant of claim 38 wherein, the soy methyl ester is about 5 to about 55 weight percent based upon the weight of the biopenetrating lubricant.

50. A bio-penetrating lubricant comprising:

(A) at least one triglyceride oil of the formula

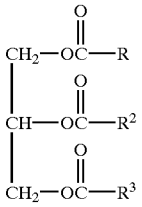

wherein $R^1$, $R^2$, and $R^3$ are aliphatic hydrocarbyl groups containing from about 7 to about 23 carbon atoms;

(B) an organic solvent selected from the group comprising:
(1) ethyl lactate,
(2) soy methyl ester,
(3) at least one food grade mineral spirit, and
(4) combinations of 1, 2, and 3;

(C) an anti-oxidant;

(D) an anti-wear inhibitor;

(E) a corrosion inhibitor;

(F) a pour point depressant; and, (G) a component chosen from the group comprising:
(1) a food grade tackifier;
(2) molybdenum disulfide; and
(3) a combination of 1 and 2.

* * * * *